US007628481B2

(12) United States Patent
Kadomatsu et al.

(10) Patent No.: US 7,628,481 B2
(45) Date of Patent: Dec. 8, 2009

(54) IMAGE FORMING METHOD AND INKJET RECORDING APPARATUS

(75) Inventors: Tetsuzo Kadomatsu, Kanagawa (JP); Masaaki Konno, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 571 days.

(21) Appl. No.: 11/409,953

(22) Filed: Apr. 25, 2006

(65) Prior Publication Data

US 2006/0238592 A1 Oct. 26, 2006

(30) Foreign Application Priority Data

Apr. 26, 2005 (JP) ..... 2005-128286

(51) Int. Cl.
*B41J 2/01* (2006.01)

(52) U.S. Cl. ..... 347/102; 347/101

(58) Field of Classification Search ..... 347/101, 347/102, 103, 104
See application file for complete search history.

(56) References Cited

U.S. PATENT DOCUMENTS

2005/0190248 A1* 9/2005 Konno et al. ..... 347/102
2006/0164487 A1* 7/2006 Kadomatsu et al. ..... 347/102

FOREIGN PATENT DOCUMENTS

JP 2001-179959 A 7/2001
JP 2001-348519 A 12/2001

* cited by examiner

*Primary Examiner*—Manish S Shah
(74) *Attorney, Agent, or Firm*—Birch, Stewart, Kolasch & Birch, LLP

(57) ABSTRACT

The image forming method includes: a treatment liquid deposition step of depositing, on a recording medium, a treatment liquid which reacts with a water-based emulsion-type ink having a water-based ink solvent, a pigment-based coloring material and at least one constituent material of a radiation-curable monomer, a radiation-curable oligomer, and a mixture material of the radiation-curable monomer and the radiation-curable oligomer; an ink ejection step of ejecting the water-based emulsion-type ink by means of an inkjet head toward the recording medium on which the treatment liquid has been deposited in the treatment liquid deposition step; a radiation irradiation step, in a state where the water-based emulsion-type ink has reacted with the treatment liquid on the recording medium after the ink ejection step and an aggregate of the pigment-based coloring material and the at least one constituent material is separated in phase from a liquid component including the water-based ink solvent, of irradiating radiation onto at least the aggregate on the recording medium, to cure the aggregate; and a liquid removal step of removing at least a portion of the liquid component from the recording medium, after the radiation irradiation step.

6 Claims, 6 Drawing Sheets

IMAGE FORMING METHOD AND INKJET RECORDING APPARATUS

BACKGROUND OF THE INVENTION

1. Field of the Invention

The present invention relates to an image forming method and an inkjet recording apparatus, and more particularly, to image formation technology for an inkjet recording apparatus which uses a radiation-curable ink, such as an ultraviolet-curable ink.

2. Description of the Related Art

Inkjet recording apparatuses having an inkjet head in which a plurality of nozzles are arranged, have been known as image forming apparatuses. An inkjet recording apparatus of this kind forms images by forming dots on a recording medium, by ejecting ink as droplets from nozzles, while causing the inkjet head and the recording medium to move relatively to each other.

As inks used in inkjet printers, there are inks which are cured when receiving radiation, such as ultraviolet (UV) light, an electron beam (EB), or the like. An ultraviolet-curable ink (UV ink) is, for example, composed of a coloring material, a polymerizing monomer or oligomer (more specifically, an ultraviolet-curable monomer (UV monomer) or an ultraviolet-curable oligomer (UV oligomer)), and a polymerization initiator and polymerization promoter, and the like, which cause a bridging reaction or polymerization reaction of the monomer or oligomer to take place, due to a photocatalytic reaction. The ink hardens due to the bridging reaction or polymerization reaction when irradiated with ultraviolet light.

In the light-curable ink described in Japanese Patent Application Publication No. 2001-348519, a high-boiling-point wetting agent comprising at least one of a reactive monomer, a reactive oligomer, a reactive polymer, and a reactive sugar, is included in a two-liquid type ink composition, a multivalent metallic salt and photosetting agent are included in an aggregating liquid, and the ink and the aggregating agent are made to react with each other, thereby improving image quality and weather resistance, and preventing "stickiness" of the image section due to residue of the non-volatile wetting agent.

Furthermore, in the ink absorbing body and the image forming apparatus and method using this ink absorbing body described in Japanese Patent Application Publication No. 2001-179959, the coloring material and the solvent component in the ink are separated after deposition of the ink on the recording medium, and only the solvent component is absorbed by the absorbing body having separating properties, thereby promoting drying.

However, in general, when ink of a type that is cured by irradiation of ultraviolet light, or the like, is used (for example, the curable ink described in Japanese Patent Application Publication No. 2001-348519), then relief effects occur in the recording image due to the height of the dots formed on the recording medium.

In the light-curable ink described in Japanese Patent Application Publication No. 2001-348519, it is possible to reduce the height of the dots formed on the recording medium by drying the recording medium after printing, for example, but it is difficult to remove the water content at high speed by means of a small amount of energy. Furthermore, it makes no mention of technology for removing the water content remaining on the recording medium, in order to shorten the drying time, which is a problem in the case of high-speed printing.

Furthermore, in the ink absorbing body and the image forming apparatus and method using the ink absorbing body described in Japanese Patent Application Publication No. 2001-179559, ink coloring material may adhere to the absorbing body, and this ink coloring material adhering to the absorbing body may then become attached to another image or recording medium, thus causing soiling. Furthermore, there is also a problem in that the fixing properties of the ink coloring material are poor in the case of non-permeable recording medium.

SUMMARY OF THE INVENTION

The present invention has been contrived in view of these circumstances, an object thereof being to provide an image forming method and an inkjet recording apparatus whereby images of high quality can be obtained, as well as enabling high-speed printing, by improving the efficiency of drying a recording medium after image formation, in an inkjet printing system using a radiation-curable ink.

In order to attain the aforementioned object, the present invention is directed to an image forming method, comprising: a treatment liquid deposition step of depositing, on a recording medium, a treatment liquid which reacts with a water-based emulsion-type ink comprising a water-based ink solvent, a pigment-based coloring material and at least one constituent material of a radiation-curable monomer, a radiation-curable oligomer, and a mixture material of the radiation-curable monomer and the radiation-curable oligomer; an ink ejection step of ejecting the water-based emulsion-type ink by means of an inkjet head toward the recording medium on which the treatment liquid has been deposited in the treatment liquid deposition step; a radiation irradiation step, in a state where the water-based emulsion-type ink has reacted with the treatment liquid on the recording medium after the ink ejection step and an aggregate of the pigment-based coloring material and the at least one constituent material is separated in phase from a liquid component including the water-based ink solvent, of irradiating radiation onto at least the aggregate on the recording medium, to cure the aggregate; and a liquid removal step of removing at least a portion of the liquid component from the recording medium, after the radiation irradiation step.

According to the present invention, in an inkjet recording apparatus which forms a desired image on a recording medium using a water-based emulsion-type ink, a pigment-based coloring material and a constituent material comprising at least one of a radiation-curable monomer, a radiation-curable oligomer, and a mixture of the radiation-curable monomer and the radiation-curable oligomer, are caused to aggregate, and furthermore, the aggregate and the liquid component including the ink solvent are caused to separate and the aggregate is cured by irradiation of radiation, whereupon the liquid component on the recording medium is removed. Therefore, it is possible to remove the liquid at a higher speed and an improvement in liquid removal efficiency can be expected, in comparison with heat-based drying.

Furthermore, the energy required for liquid removal processing is reduced in comparison with heat-based drying, and furthermore, since there is the liquid component over the aggregate, obstruction to the polymerization process by oxygen is prevented, and the energy required to curing the aggregate is reduced. Moreover, it is also possible to reduce the ink height, and odors and evaporation of undesirable substances, or the like, are suppressed more efficiently, in comparison with ink of a type in which the majority of the deposited ink is fixed on recording medium.

In other words, the liquid component on the recording medium is removed at high speed and with low energy, in addition to which the height of the dots formed on the recording medium is lowered, and relief effects occurring in the image formed on the recording medium are reduced.

The water-based emulsion-type ink comprises a pigment-based coloring material, and at least one constituent material of: a radiation-curable monomer, a radiation-curable oligomer, and a mixture material of the radiation-curable monomer and the radiation-curable oligomer, which are emulsified (dispersed) in an ink solvent having water as a principal component.

The deposition of the treatment liquid onto the treatment liquid in the treatment liquid deposition step may involve depositing the treatment liquid uniformly onto the recording medium, regardless of the image data to be formed on the recording medium, or it may be deposited in accordance with the image data.

Moreover, "recording medium" indicates a medium which receives ejection of an image forming body by means of an ejection head, and this term includes various types of recording media, irrespective of material and size, such as continuous paper, cut paper, sealed paper, resin sheets, such as OHP sheets, film, cloth, and other materials.

Preferably, the image forming method further comprises a drying step of drying the recording medium from which the at least the portion of the liquid component has been removed in the liquid removal step.

According to this aspect of the present invention, by providing the drying step after the liquid removal step, it is possible to remove the liquid component which has not been removed in the liquid removal step, in a reliable fashion. In this drying step, a desirable mode is one in which the drying capability is controlled in accordance with the type of recording medium and the amount of liquid component remaining on the recording medium.

In order to attain the aforementioned object, the present invention is also directed to an inkjet recording apparatus, comprising: a treatment liquid deposition device which deposits, on a recording medium, a treatment liquid which reacts with a water-based emulsion-type ink comprising a water-based ink solvent, a pigment-based coloring material and at least one constituent material of a radiation-curable monomer, a radiation-curable oligomer, and a mixture material of the radiation-curable monomer and the radiation-curable oligomer; an inkjet head which ejects the water-based emulsion-type ink toward the recording medium on which the treatment liquid has been deposited by the treatment liquid deposition device; a radiation irradiation device which irradiates radiation, in a state where the water-based emulsion-type ink ejected by the inkjet head has reacted with the treatment liquid deposited by the treatment liquid deposition device on the recording medium and an aggregate of the pigment-based coloring material and the at least one constituent material is separated in phase from a liquid component including the water-based ink solvent, onto at least the aggregate on the recording medium, thereby curing the aggregate; and a liquid removal device which removes at least a portion of the liquid component from the recording medium in a state where the aggregate is separated from the liquid component.

Preferably, a conveyance device is provided in order to convey the recording medium in the prescribed direction (for example, a direction substantially perpendicular to the breadthways direction of the recording medium), and the treatment liquid deposition device, the inkjet head, the radiation irradiation device, and the liquid removal device are disposed in this order, from the upstream side in the conveyance direction of the conveyance device. It is also possible to move the treatment liquid deposition device, the inkjet head, and the like, with respect to a fixed recording medium, and it is also possible to move both the recording medium and the treatment liquid deposition device, and the like.

The inkjet head may be a line type head having a row of ejection holes of a length corresponding to the full width of the recording medium (the width of the possible image formation region of the recording medium), or a serial head which uses a short head having an ejection hole row of a length that does not reach the full width of the recording medium, and which moves this head back and forth in the breadthways direction of the recording medium.

A line inkjet head may be formed to a length corresponding to the full width of the recording medium by combining short head having rows of ejection holes which do not reach a length corresponding to the full width of the recording medium, these short heads being joined together in a staggered matrix fashion.

Preferably, the inkjet recording apparatus further comprises a drying device which dries the recording medium from which the at least the portion of the liquid component has been removed by the liquid removal device.

A desirable mode is one in which a drying control device which controls the drying capability of the drying device is provided, and the drying capability of the drying device is controlled in accordance with the type of recording medium and the amount of liquid component remaining on the recording medium.

Preferably, the liquid removal device has an absorbing body which makes contact with the liquid component on the recording medium, thereby absorbing and removing the at least the portion of the liquid component from the recording medium.

A desirable mode is one which comprises a pressing control device that controls the pressing force of the absorbing body against the recording medium, in such a manner that the absorption capability of the absorbing body is controlled by controlling the pressing force. A porous member, nonwoven cloth, polymer material, or the like, may be used suitably as the absorbing body.

Preferably, the treatment liquid deposition device includes a treatment liquid ejection head which ejects the treatment liquid toward the recording medium.

According to this aspect of the present invention, if a treatment liquid ejection head is used as the treatment liquid deposition device, then it is possible to deposit treatment liquid in accordance with the region on which the ink is to be deposited on the recording medium, and therefore reduced consumption of treatment liquid can be expected, in comparison with a case where the treatment liquid is deposited uniformly over the recording medium. In a mode comprising the treatment liquid ejection head, it is possible to eject treatment liquid in accordance with the image data, or it is also possible to eject treatment liquid on the basis of the treatment liquid ejection data.

The treatment liquid ejection head may be formed in an integral fashion with the inkjet head, or it may be formed as a portion of the inkjet head.

According to the present invention, a treatment liquid is made to react with the water-based emulsion-type ink on the recording medium, the pigment-based coloring material contained in the ink and the radiation-curable monomer, and the like, are made to aggregate, the aggregate and the liquid component including the ink solvent are separated, whereupon radiation is irradiated onto the aggregate of the pigment-based coloring material and the radiation-curable monomer, and the like, thereby curing same, and the liquid component including ink solvent is then removed. Therefore, increased speed in liquid removal and improved liquid removal efficiency can be expected, in comparison with liquid removal by heat-based drying. Furthermore, by using a water-based emulsion-type ink, and thus reducing the ink height on the recording medium in comparison with ink of a type where the majority of the ink fixes on the recording medium, it is possible to reduce relief effects in the recording image, and suppress odors and the evaporation of undesirable substances.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
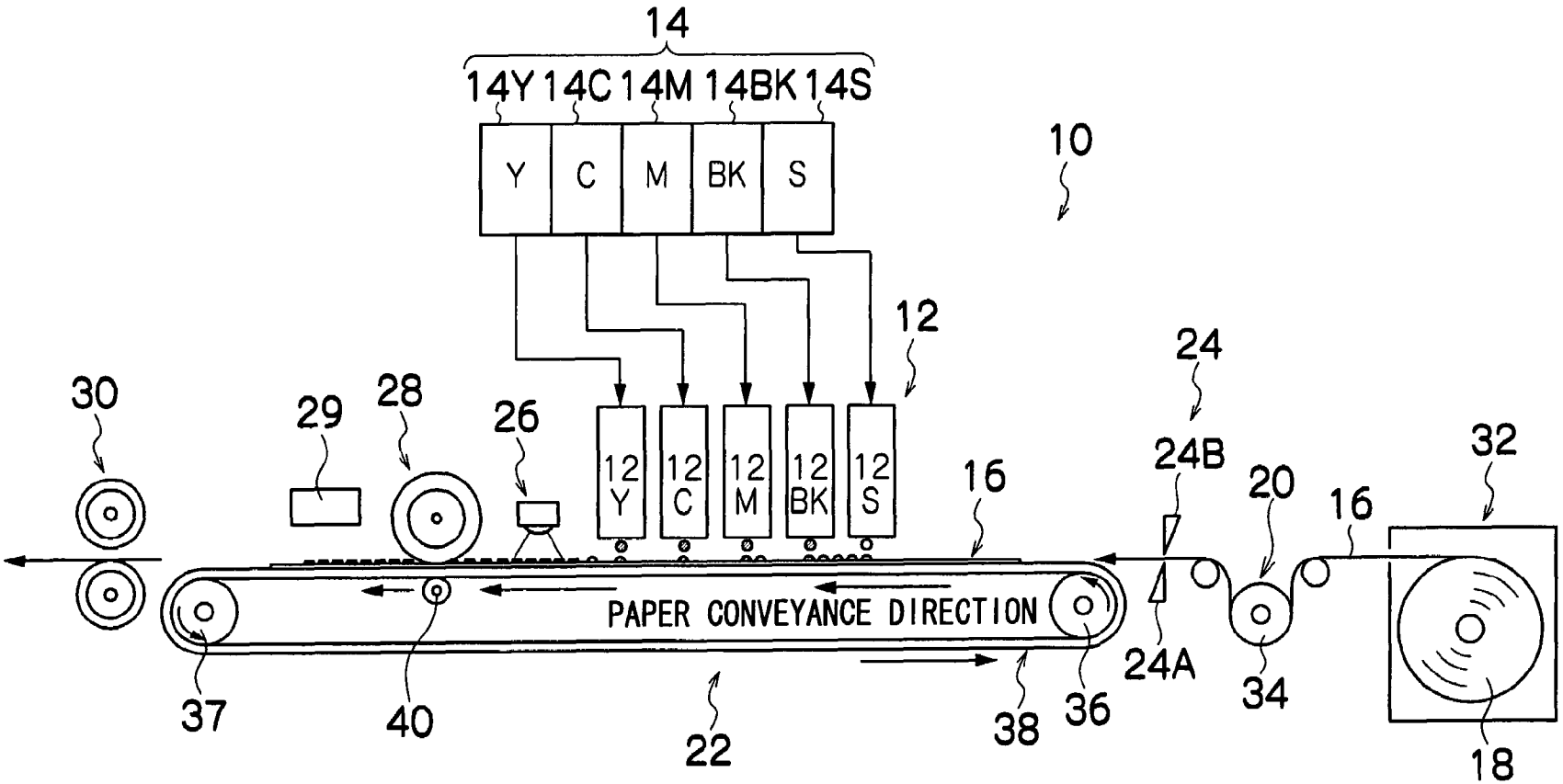
FIG. 1 is a general schematic drawing of an inkjet recording apparatus according to the present invention.

FIG. 1 is a general schematic drawing of an inkjet recording apparatus 10 which forms an image forming apparatus according to the present invention. In the inkjet recording apparatus 10 shown in the present embodiment, an ink coloring material and constituent material contained in the ink are caused to aggregate and settle downwards, by making the ink react with a treatment liquid on the recording medium, as well as separating the ink solvent (the liquid component including ink solvent) and the aggregate of the ink coloring material and the ink constituent material into separate phases. Moreover, in this state of separated phases, ultraviolet (UV) light is irradiated so that the aggregate of the ink coloring material and the ink constituent material is cured, whereupon the liquid component including the ink solvent is removed.

The ink used in the inkjet recording apparatus 10 is an ultraviolet-curable ink (UV ink) of water-based emulsion-type containing a pigment-based ink coloring material. The details of the water-based emulsion-type UV ink are described later.

As shown in FIG. 1, the inkjet recording apparatus 10 according to the present embodiment has a print unit 12 including a plurality of print heads (ink heads) 12BK, 12M, 12C and 12Y, which eject inks of colors of black (BK), magenta (M), cyan (C) and yellow (Y), respectively, and a treatment liquid ejection head 12S, which ejects treatment liquid, positioned before the print heads 12BK, 12M, 12C and 12Y. Below, the print heads 12BK, 12M, 12C and 12Y, and the treatment liquid ejection head 12S may be referred to simply as the heads 12S, 12BK, 12M, 12C and 12Y without making a particular distinction between the respective heads.

The inkjet recording apparatus 10 also has an ink storing and loading unit 14 including ink tanks 14BK, 14M, 14C and 14Y, which store the inks of colors (BK, M, C and Y) to be supplied to the print heads 12BK, 12M, 12C and 12Y, respectively, and a treatment liquid tank 14S, which stores the treatment liquid to be supplied to the treatment liquid ejection head 12S. As described above, the ink used here is the radiation-curable ink in which the ink coloring material, and the like, contained in the ink is cured by irradiation of ultraviolet (UV) light. For this radiation-curable ink, it is also possible to use an ink in which the ink coloring material, and the like, is cured by irradiation of radiation other than the UV light, for instance, an electron beam (EB).

On the other hand, the treatment liquid used in the inkjet recording apparatus 10 has properties (described in more detail later) that cause it to generate an aggregate of the coloring material and an aggregate of the ink constituent material, by reacting with the water-based emulsion-type UV ink, and breaking down the dispersed state of the ink coloring material and the ink constituent material so that the ink solvent and the solute, such as the ink coloring material, are separated into distinct phases.

The ink storing and loading unit 14 has the treatment liquid tank 14S and the ink tanks 14BK, 14M, 14C and 14Y for storing the treatment liquid and the inks of the colors corresponding to the heads 12S, 12BK, 12M, 12C and 12Y, and the tanks are connected to the heads 12S, 12BK, 12M, 12C and 12Y by means of prescribed channels (not shown), respectively. The ink storing and loading unit 14 also has a warning device, such as a display device or an alarm sound generator for warning when the remaining amount of treatment liquid or ink is low, and has a mechanism for preventing loading errors among the ink colors, and between the treatment liquid and the ink.

A paper supply unit 18 for supplying recording paper 16, a decurling unit 20, which removes curl from the recording paper 16, and a cutter 24, which cuts the recording paper 16 that has been decurled by the decurling unit 20, to a prescribed length, are provided before the print unit 12 (namely, on the upstream side thereof in terms of the paper conveyance direction, which is the direction of movement of the recording paper 16). After being cut to a prescribed length by the cutter 24, the recording paper 16 is supplied to a belt conveyance unit 22.

The belt conveyance unit 22 is disposed so as to oppose the nozzle surface of the print unit 12 (the ink or treatment liquid ejection surface on which the nozzles of the heads are formed), and the belt conveyance unit 22 conveys the recording paper 16 from the paper supply unit 18 to the print unit 12, while keeping the recording paper 16 flat at least in the print region corresponding to the print unit 12 (namely, the region where the treatment liquid and the inks are applied onto the recording paper 16 from the heads 12S, 12BK, 12M, 12C and 12Y).

A UV light source 26, which irradiates UV light onto the print surface (the image formation surface on which an image is formed) of the recording paper 16, a porous roller 28, which absorbs and removes liquid including the ink solvent and unreacted treatment liquid, from the recording paper 16, and a drying unit 29, which dries the recording paper 16 after the liquid removal, are disposed on the downstream side of the print unit 12 in terms of the paper conveyance direction. Furthermore, a paper output unit 30 for outputting recorded paper (a printed object) to the exterior is provided on the downstream side of the belt conveyance unit 22 from the drying unit 29, in terms of the paper conveyance direction.

The paper supply unit 18 is shown as including a magazine 32 for rolled paper (continuous paper) in the embodiment shown in FIG. 1; however, a plurality of magazines with paper differences such as paper width and quality may be provided. Moreover, paper may be supplied from cassettes which contain cut paper loaded in layers and which are used jointly or in lieu of the magazine 32 for rolled paper.

If a composition is adopted in which a plurality of types of recording paper 16 can be used, then by attaching an information recording body, such as a barcode, wireless tag, or the like, which records various types of information on the recording paper 16, to the magazine, and by reading the information on the information recording body by means of the prescribed reading device, it is possible to automatically determine the type of recording paper 16 used. In this case, desirably, the ink ejection is controlled and the conveyance by the belt conveyance unit 22 is controlled, in such a manner that suitable ink ejection is achieved in accordance with the type of recording paper 16.

The recording paper 16 delivered from the paper supply unit 18 retains curl due to having been loaded in the magazine 32. In order to remove the curl, heat is applied to the recording paper 16 in the decurling unit 20 by a heating drum 34 in the direction opposite from the curl direction in the magazine 32. The heating temperature at this time is preferably adjusted so that the recording paper 16 has a curl in which the surface on which the print is to be made is slightly round outward.

In the case of the configuration in which roll paper is used, a cutter 24 is provided as shown in FIG. 1, and the continuous paper is cut into a desired size by the cutter 24. The cutter 24 has a stationary blade 24A, whose length is not less than the width of the conveyor pathway of the recording paper 16, and a round blade 24B, which moves along the stationary blade 24A. The stationary blade 24A is disposed on the reverse side of the printed surface of the recording paper 16, and the round blade 24B is disposed on the printed surface side across the conveyance pathway. When cut papers are only used, the cutter 24 is not required.

After decurling, the cut recording paper 16 is delivered to the belt conveyance unit 22. The belt conveyance unit 22 has a structure in which an endless conveyance belt (electrostatic attraction belt) 38 is wound between two rollers 36 and 37. The belt conveyance unit 22 is composed in such a manner that at least the portion thereof which opposes the nozzle surface of the heads 12S, 12BK, 12M, 12C and 12Y forms a flat surface.

The conveyance belt 38 is an electrostatic attraction belt, which conveys the recording paper 16 while attracting and fixing the recording paper 16 by electrostatic force onto the surface of the conveyance belt 38. The conveyance belt 38 is constituted by a conducting member and is connected electrically to a DC power supply (not shown). Instead of the electrostatic attraction belt, it is also possible to adopt another composition in which a belt member having a plurality of small holes in the surface thereof is used as a conveyance belt 38, and by suctioning air from the opposite side of the belt member with respect to the recording paper holding surface thereof, by means of a fan or other such suction device, so that the recording paper 16 is held onto the recording paper holding surface of the belt member by air suction.

The rollers 36 and 37 are driven to rotate in the counterclockwise direction in FIG. 1, by means of the driving force of a motor 88 (not shown in FIG. 1, but shown in FIG. 6) being transmitted to at least one of the rollers 36 and 37, about which the conveyance belt 38 is wound. By this means, the recording paper 16 is held on the conveyance belt 38 and is conveyed from right to left in FIG. 1.

The heads 12S, 12BK, 12M, 12C and 12Y are full line heads, each of which has a length corresponding to the maximum width of the recording paper 16 used with the inkjet recording apparatus 10, and has a plurality of treatment liquid ejection nozzles or ink ejection nozzles arranged on a nozzle face through a length exceeding at least one edge of the maximum-size recording paper 16 (namely, the full width of the printable range).

Figure 2:
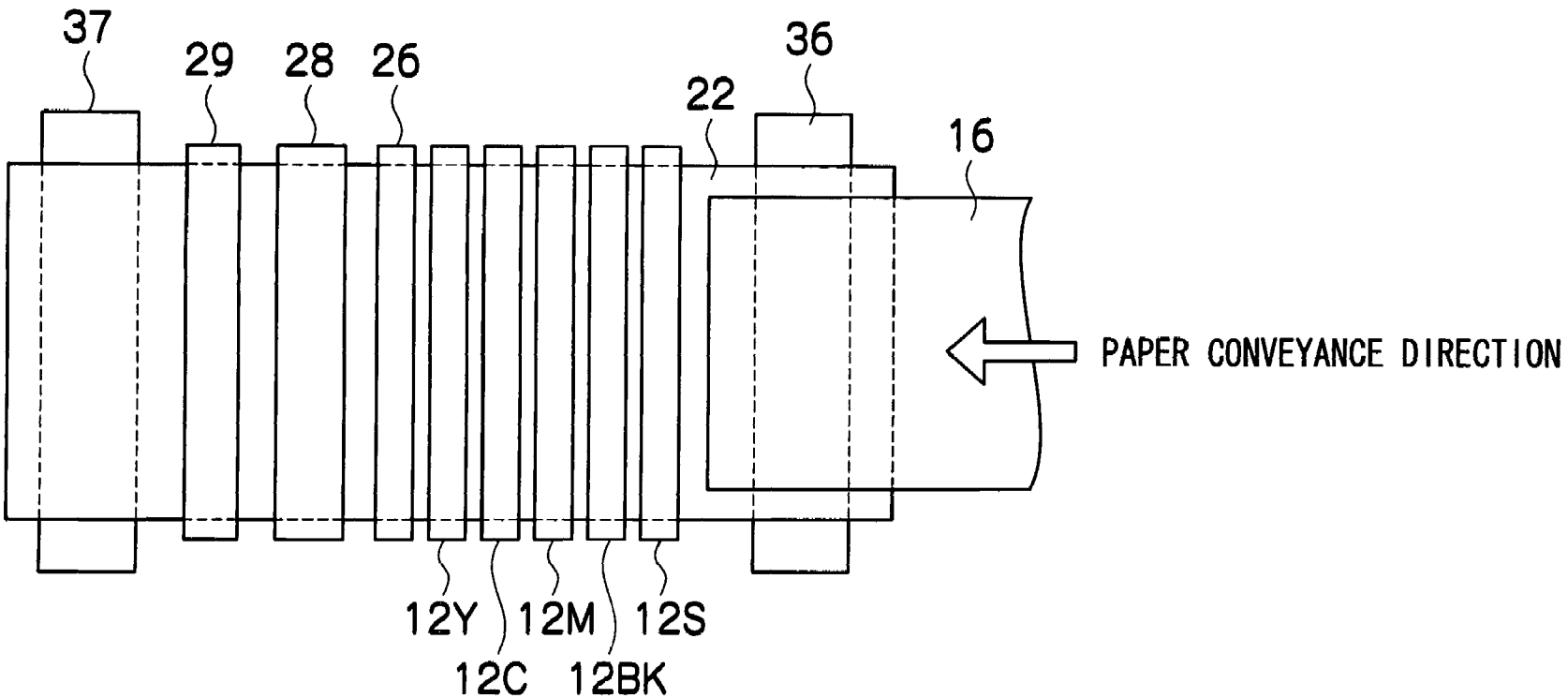
FIG. 2 is a principal plan diagram of the peripheral area of a print unit in the inkjet recording apparatus shown in FIG. 1.

As shown in FIG. 1, the heads 12S, 12BK, 12M, 12C and 12Y are arranged in this order from the upstream side in the conveyance direction of the recording paper 16 (paper feed direction), and the heads 12S, 12BK, 12M, 12C and 12Y are fixed extending in a direction (the main scanning direction) that is substantially perpendicular to the conveyance direction of the recording paper 16 (the sub-scanning direction) (see FIG. 2).

The print unit 12, in which the full-line heads covering the entire width of the paper are thus provided corresponding to the treatment liquid and the inks of the colors, can record an image over the entire surface of the recording paper 16 by performing the action of moving the recording paper 16 and the print unit 12 relatively to each other in the paper feed direction just once (in other words, by means of a single sub-scan). Higher-speed printing is thereby made possible and productivity can be improved in comparison with a shuttle type head configuration in which a print head moves in a main scanning direction that is substantially perpendicular to the paper feed direction.

Although a configuration with four standard colors, K (BK), M, C and Y, is described in the present embodiment, the combinations of the ink colors and the number of colors are not limited to these, and light and/or dark inks can be added as required. For example, a configuration is possible in which heads for ejecting light-colored inks such as light cyan and light magenta, or heads for ejecting dark-colored inks, such as dark yellow, are added. Moreover, also possible is a mode in which a plurality of the heads having the highest frequency of use, such as BK, are provided, and furthermore, it is also possible to provide a plurality of treatment liquid ejection heads 12S, in order to be able to handle treatment liquids having different physical properties (viscosity, surface tension on the recording paper 16) and compositions.

In the inkjet recording apparatus 10 having the print unit 12 as described above, a color image is formed on the recording paper 16, by firstly ejecting the treatment liquid from the treatment liquid ejection head 12S, and then ejecting the inks of colors from the print heads 12BK, 12M, 12C and 12Y, while conveying the recording paper 16 in the paper feed direction, by means of the belt conveyance unit 22. In this case, when the treatment liquid and the ink mix together and react on the recording paper 16, an aggregate of the ink coloring material, and the like, is generated, and the ink solvent and the aggregate of the ink coloring material, and the like, are separated. The details of this two-liquid reaction are described later.

The UV light source 26, which is disposed on the downstream side of the print unit 12 in terms of the paper feed direction, irradiates UV light onto the aggregate of the ink coloring material, and the like, thereby curing the aggregate. As shown in FIG. 2, the UV light source 26 provided in the inkjet recording apparatus 10 has a length corresponding to the full width of the recording paper 16. It is also possible to use a UV light source having a length that is shorter than the full width of the recording paper 16, and to move this light source in the breadthways direction of the recording paper 16 (a direction substantially perpendicular to the paper feed direction). Alternatively, it is also possible to compose a UV light source having a length corresponding to the full width of the recording paper 16 by combining together a plurality of UV light sources which are each of a length that is shorter than the full width of the recording paper 16. Moreover, the UV light source 26 may be provided with an optical member that varies the irradiation range of the UV light, or a rotating mechanism that changes the irradiation range of the UV light by rotating the UV light source 26. Furthermore, a composition is possible in which a movement mechanism for moving the UV light source 26 in a direction perpendicular to the print surface of the recording paper 16 (a direction including a vertical component) is provided, and the intensity of the UV light is varied by altering the distance between the UV light source 26 and the recording paper 16.

The porous roller 28 is disposed on the downstream side of the UV light source 26 in terms of the paper feed direction, and it absorbs and removes liquid remaining on the recording paper 16, such as ink solvent separated by the reaction between the ink and the treatment liquid, and unreacted treatment liquid, or the like. Furthermore, an opposite roller 40 is provided so as to oppose the porous roller 28 on the opposite side of the conveyance belt 38.

At least the portion of the porous roller 28 that makes contact with the liquid on the recording paper 16 is made of a flexible and porous member, which removes the liquid on the recording paper 16 by means of capillary action. Instead of, or in conjunction with, the flexible and porous member, it is also possible to use an absorbing and removing member made of nonwoven cloth, polymer material, or the like.

As shown in FIG. 2, the porous roller 28 has a length corresponding to the full width of the recording paper 16. It is also possible to use a porous roller having a length that is shorter than the full width of the recording paper 16, and to move this roller in the breadthways direction of the recording paper 16. Alternatively, it is also possible to compose the porous roller of a length corresponding to the full width of the recording paper 16 by combining together a plurality of porous rollers which are each of a length that is shorter than the full width of the recording paper 16.

The recording paper 16 on which a desired image has been formed and the residual liquid has been removed in this way is then subjected to a drying process by means of the drying unit 29, thereby removing the water content (liquid) remaining on the recording paper 16. The drying unit 29 is constituted by a heat source (not shown), such as an infrared heater, and a fan (not shown), which blows the heat generated by the infrared heater onto the printed surface of the recording paper 16.

The recording paper 16 on which a desired image has been formed in this way is then outputted to the exterior from the paper output unit 30, which is disposed on the downstream side of the belt conveyance unit 22 in terms of the paper feed direction. Moreover, although omitted from the drawing, a sorter for collating and stacking the images according to job orders is provided in the paper output unit 30, for example.

Structure of Head

Next, the structure of the heads 12S, 12BK, 12M, 12C and 12Y is described. The heads 12S, 12BK, 12M, 12C and 12Y have the same structure, and a reference numeral 50 is hereinafter designated to any of the heads.

Figure 3A:
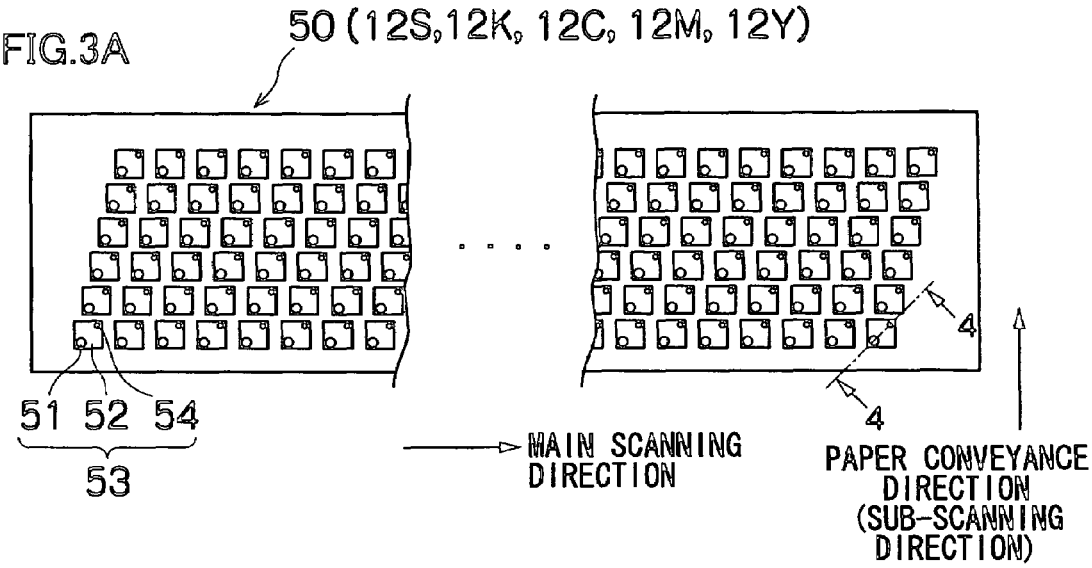
FIGS. 3A to 3C are plan view perspective diagrams showing an embodiment of the composition of a print head.
Figure 3B:
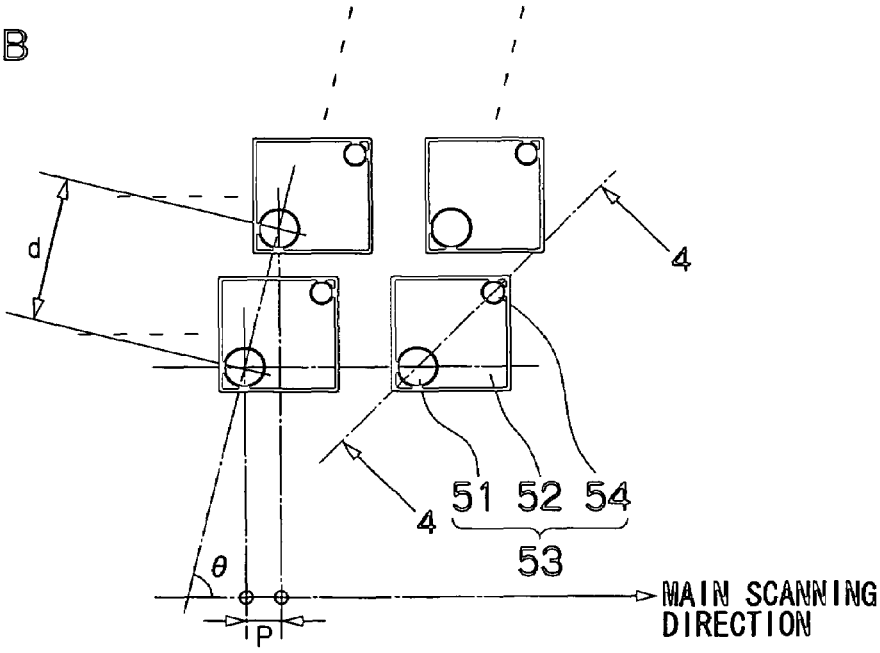
Figure 3C:
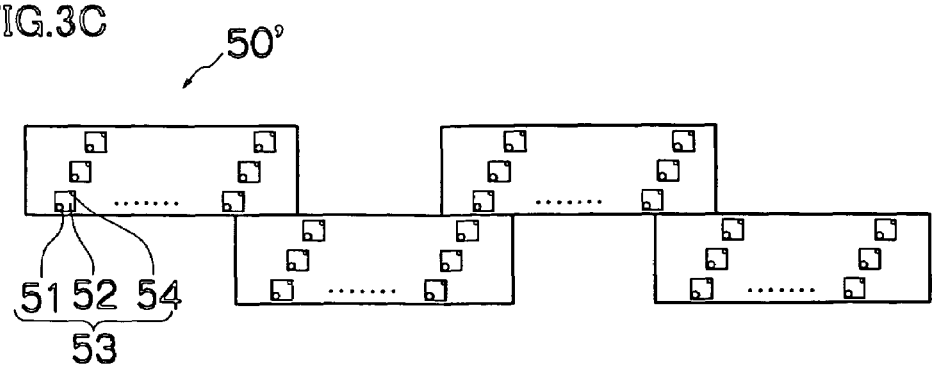
Figure 4:
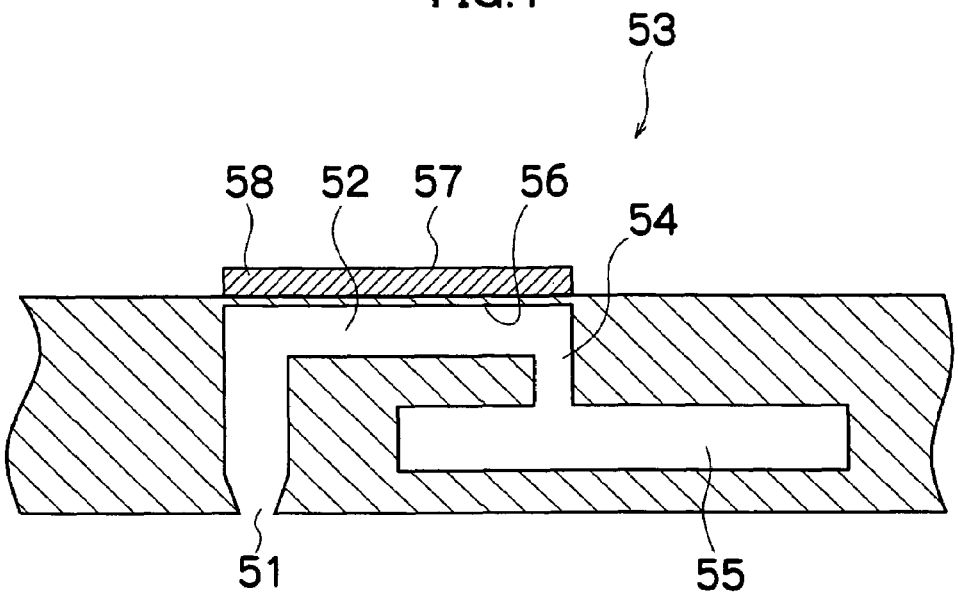
FIG. 4 is a cross-sectional view along line 4-4 in FIGS. 3A and 3B.

FIG. 3A is a plan view perspective diagram showing an embodiment of the structure of a head 50, and FIG. 3B is an enlarged diagram of a portion of same. FIG. 3C is a plan perspective view showing another embodiment of the structure of a head 50. FIG. 4 is a cross-sectional view showing the three-dimensional composition of an ink chamber unit (a cross-sectional view along line 4-4 in FIGS. 3A and 3B). In order to achieve a high resolution of the dots printed onto the surface of the recording medium, it is necessary to achieve a high density of the nozzles in the head 50. As shown in FIGS. 3A and 3B, the head 50 in the present embodiment has a structure in which a plurality of ink chamber units 53 including nozzles 51 for ejecting ink droplets and pressure chambers 52 corresponding to the nozzles 51 are disposed in the form of a staggered matrix, and the effective nozzle pitch is thereby made small.

More specifically, as shown in FIGS. 3A and 3B, the head 50 according to the present embodiment is a full-line head having one or more nozzle rows in which a plurality of nozzles 51 for ejecting ink are arranged along a length corresponding to the entire width of the recording paper 16 (printable width) in a direction substantially perpendicular to the paper conveyance direction.

Moreover, as shown in FIG. 3C, the head 50 may also be formed to have a length corresponding to the full width of the recording paper 16 by combining, in a staggered arrangement, a plurality of short heads 50' in which nozzles are two-dimensionally arranged.

Since it is sufficient that the treatment liquid is applied to the recording paper 16 in a substantially uniform (even) fashion in the region where ink droplets are to be deposited, then it is not necessary to form dots of the treatment liquid to a high resolution, in comparison with the ink. Consequently, the treatment liquid ejection head 12S may be composed with a reduced number of nozzles (a reduced nozzle density) in comparison with the print heads 12BK, 12M, 12C and 12Y. Furthermore, a composition may also be adopted in which the nozzle diameter of the treatment liquid ejection head 12S is greater than the nozzle diameter of the print heads 12BK, 12M, 12C and 12Y.

As shown in FIG. 3B, the planar shape of the pressure chamber 52 provided for each nozzle 51 is substantially a square, and the nozzle 51 and the supply port 54 are disposed in both corners on a diagonal line of the square.

As shown in FIG. 4, the pressure chambers 52 are connected to a common flow channel 55 through the supply ports 54. An actuator 58 provided with an individual electrode 57 is bonded to a pressure plate (diaphragm) 56, which forms the upper faces of the pressure chambers 52 and also serves as a common electrode for the actuators 58. When a drive voltage is applied between the common electrode, as which the pressure plate 56 also serves, and the individual electrode 57, the corresponding actuator 58 deforms, thereby changing the volume of the pressure chamber 52. This causes a pressure change which results in ink being ejected from the nozzle 51. When ink is ejected, new ink is supplied to the pressure chamber 52 from the common flow channel 55 through the supply port 54. The structure of the ink chamber unit 53 shown in FIG. 4 is merely one embodiment, and it is of course also possible to use another structure.

As shown in FIGS. 3A and 3B, the ink chamber units 53 having this structure are arranged in a lattice arrangement, based on a fixed arrangement pattern in a longitudinal direction of the head 50 (main scanning direction) and a direction which, rather than being perpendicular to the main scanning direction, is inclined at a fixed angle of θ with respect to the main scanning direction. By adopting a structure in which the plurality of ink chamber units 53 are arranged at a uniform pitch d in a direction having the angle θ with respect to the main scanning direction, the pitch P of the nozzles projected so as to align in the main scanning direction is d×cos θ.

More specifically, the arrangement can be treated equivalently to one in which the nozzles 51 are arranged in a linear fashion at a uniform pitch P in the main scanning direction. By means of this composition, it is possible to achieve a nozzle arrangement of high density, in which the nozzles projected to align in the main scanning direction reach a total of 2400 per inch (2400 nozzles per inch, 2400 dpi). The arrangement can be treated equivalently to one in which the nozzles 51 are linearly arranged at a uniform pitch P in the main scanning direction, and hereinafter explanation is given based on this arrangement for the sake of convenience.

In implementing the present invention, the arrangement of the nozzles is not limited to that of the embodiment shown. Moreover, the present embodiment employs a method where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink being ejected by means of the pressure applied by these bubbles.

Description of Ink Supply System and Treatment Liquid Supply System

Next, the treatment liquid supply system and the ink supply system of the inkjet recording apparatus 10 are described. In the present embodiment, the treatment liquid supply system and the ink supply system have the same basic composition, and are described with respect to the ink supply system shown in FIG. 5. Below, the treatment liquid supply system and the ink supply system may be referred to jointly as the "supply system".

Figure 5:
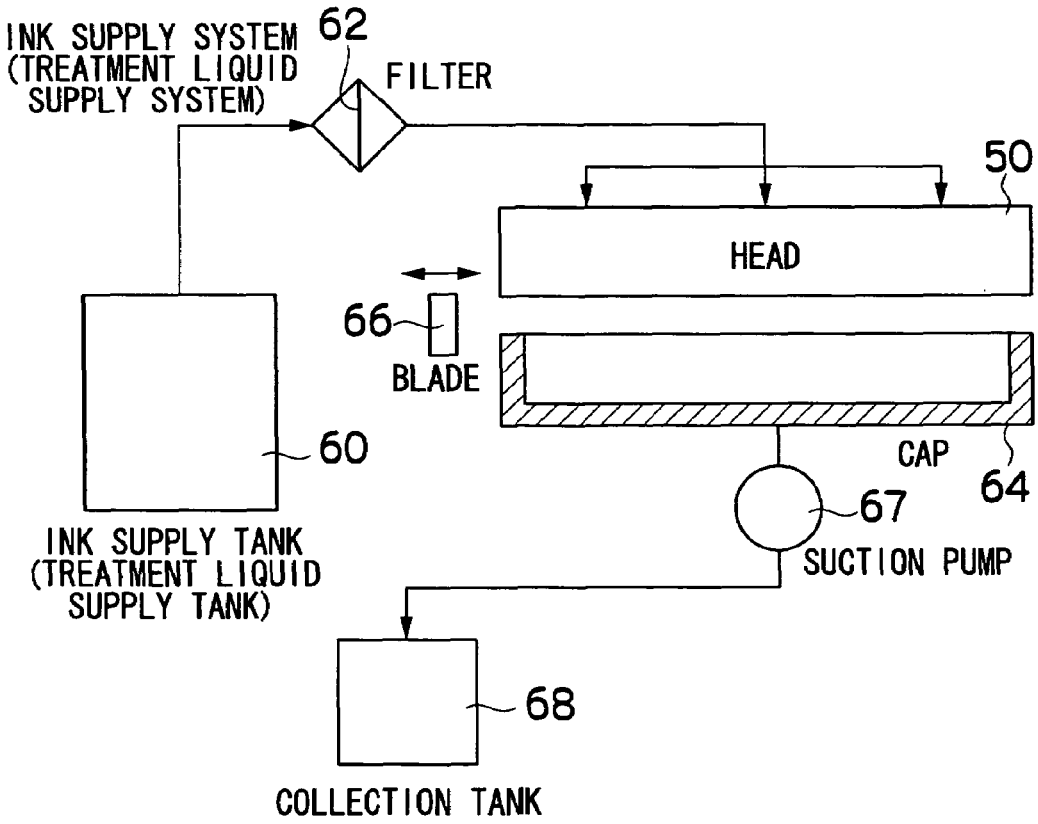
FIG. 5 is a principal block diagram showing the configuration of the supply system of the inkjet recording apparatus shown in FIG. 1.

FIG. 5 shows the composition of the ink supply system provided in the inkjet recording apparatus 10. The ink supply system shown in FIG. 5 corresponds to the storing and loading unit 14 described in FIG. 1.

An ink supply tank (or treatment liquid supply tank) 60 forming a base tank for supplying ink (or treatment liquid) is disposed in the ink supply system shown in FIG. 5. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

The ink in the ink supply tank 60 is supplied to the head 50 through prescribed tubing channels (not shown) after being passed through a filter 62 to remove foreign matter and bubbles. The filter mesh size in the filter 62 is preferably equivalent to or less than the diameter of the nozzles and is commonly about 20 μm.

Although not shown in FIG. 5, it is preferable to provide a sub-tank integrally to the head 50 or nearby the head 50. The sub-tank has a damper function for preventing variation in the internal pressure of the head 50 and a function for improving refilling of the print head.

The inkjet recording apparatus 10 is also provided with a cap 64 as a device to prevent the nozzles 51 from drying out or to prevent an increase in the ink and treatment liquid viscosity in the vicinity of the nozzles 51, and a cleaning blade 66 as a device to clean the nozzle face.

A maintenance unit including the cap 64 and the cleaning blade 66 can be relatively moved with respect to the head 50 by a movement mechanism (not shown), and is moved from a predetermined holding position to a maintenance position below the head 50 as required.

The cap is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face is thereby covered with the cap 64.

During printing or standby, if the use frequency of a particular nozzle 51 is low, and if a state of not ejecting ink or treatment liquid continues for a prescribed duration or more, then the solvent of the ink or treatment liquid in the vicinity of the nozzle evaporates and the viscosity of the ink or treatment liquid increases. In a situation of this kind, it will become impossible to eject the ink or treatment liquid from the nozzle 51, even if the actuator 58 is operated.

Therefore, before a situation of this kind develops (namely, while the ink or treatment liquid is within a range of viscosity which allows it to be ejected by operation of the actuator 58), the actuator 58 is operated, and a preliminary ejection ("purge", "blank ejection" or "dummy ejection") is carried out toward the cap 64, in order to expel the degraded ink or treatment liquid (namely, the ink or treatment liquid in the vicinity of the nozzle which has increased viscosity).

Furthermore, if bubbles enter into the ink or treatment liquid inside the head 50 (inside the pressure chamber 52), then even if the actuator 58 is operated, it is not possible to eject ink or treatment liquid from the nozzle. In a case of this kind, the cap 64 is placed on the head 50, the ink or treatment liquid containing bubbles inside the pressure chamber 52 is removed by suction, by means of a suction pump 67, and the ink or treatment liquid removed by suction is then sent to a collection tank 68.

This suction operation is also carried out in order to remove degraded ink or treatment liquid having increased viscosity (hardened ink or treatment liquid), when ink or treatment liquid is loaded into the head for the first time, and when the head starts to be used after having been out of use for a long period of time. Since the suction operation is carried out with respect to all of the ink or treatment liquid inside the pressure chamber 52, the consumption of the ink or treatment liquid is considerably large. Therefore, desirably, preliminary ejection is carried out when the increase in the viscosity of the ink or treatment liquid is still minor.

The cleaning blade 66 is composed of rubber or another elastic member, and can slide on the ink (or treatment liquid) ejection surface (surface of the nozzle plate) of the head 50 by means of a blade movement mechanism (wiper) (not shown). When foreign matter or droplets of the ink or treatment liquid have adhered to the nozzle plate, the surface of the nozzle plate is wiped and cleaned by sliding the cleaning blade 66 on the nozzle plate. After the soiling on the ink (or treatment liquid) ejection surface is cleaned away by the blade mechanism, a preliminary ejection is carried out in order to prevent the foreign matter from becoming mixed inside the nozzles 51 by the blade.

Description of Control System

Figure 6:
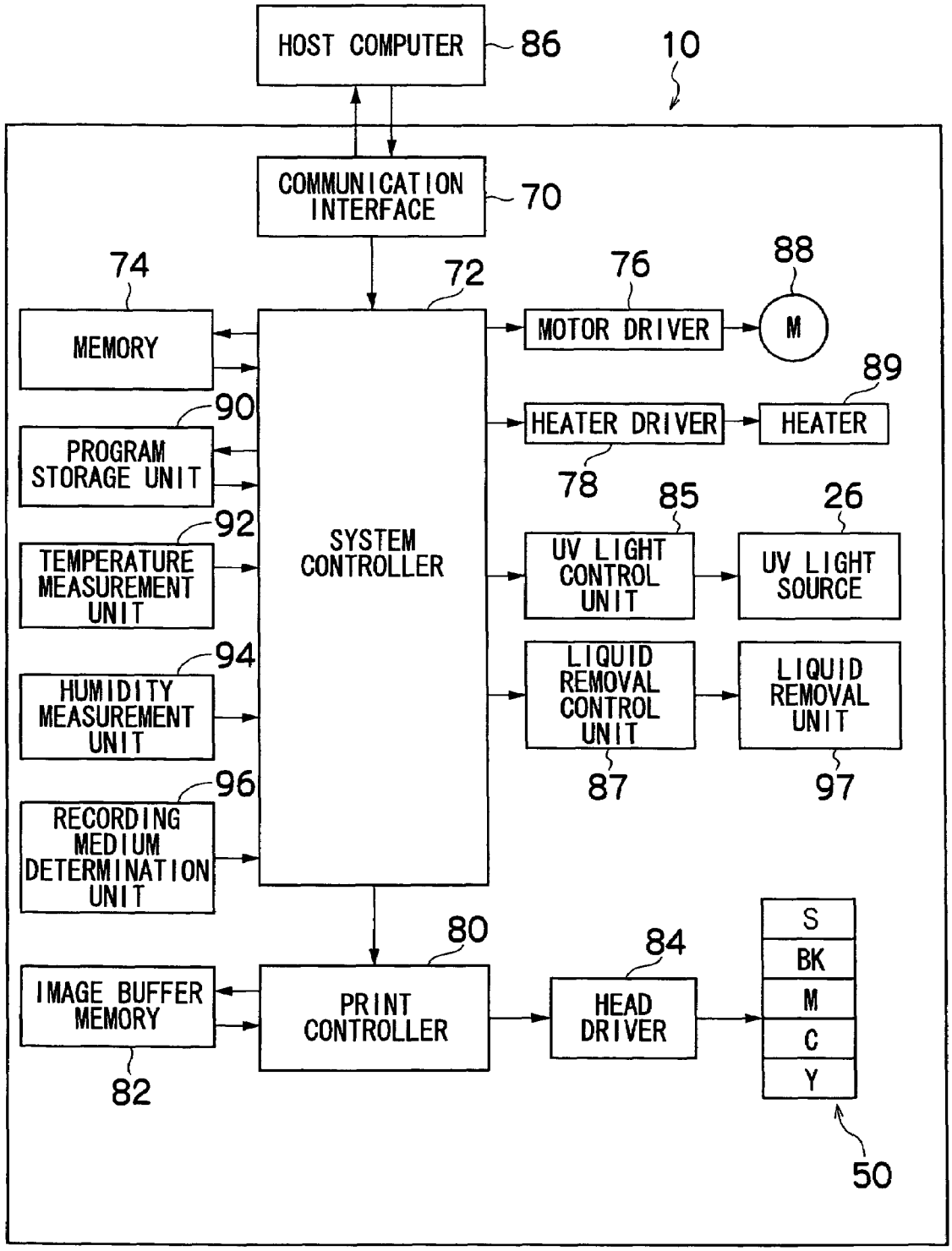
FIG. 6 is a principal block diagram showing the system configuration of the inkjet recording apparatus shown in FIG. 1.

FIG. 6 is a principal block diagram showing the system configuration of the inkjet recording apparatus 10. The inkjet recording apparatus 10 comprises a communication interface 70, a system controller 72, a memory 74, a motor driver 76, a heater driver 78, a print controller 80, an image buffer memory 82, a head driver 84, a UV light source control unit 85, a liquid removal control unit 87, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74.

The memory 74 is a storage device for temporarily storing images inputted through the communication interface 70, and data is written and read to and from the memory 74 through the system controller 72. The memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various units, such as the communication interface 70, memory 74, motor driver 76, heater driver 78, UV light source control unit 85, liquid removal control unit 87 and the like, as well as controlling communications with the host computer 86 and writing and reading to and from the memory 74, and it also generates control signals for controlling the motor 88 and heater 89 of the conveyance system.

The motor driver 76 drives the motor 88 in accordance with commands from the system controller 72. The heater driver 78 drives the heater 89 of the drying unit 29 such as the infrared heater in accordance with commands from the system controller 72.

The motor 88 shown in FIG. 6 may comprise a plurality of motors (motion actuators), such as the drive motor (not shown) of the belt conveyance unit 22. In a mode where the motor 88 comprises a plurality of motors, in order to control the plurality of motors, it is possible to provide a plurality of motor drivers 76 to correspond to the respective motors, or it is possible to form a portion or all of the plurality of motor drivers in an integrated fashion. Furthermore, the heater 89 shown in FIG. 6 may include a plurality of heaters, such as the heater of the decurling unit 20 and the heater of the drying unit 29, which are shown in FIG. 1.

The print controller 80 has a signal processing function for performing various tasks, compensations, and other types of processing for generating print control signals from the image data stored in the memory 74 in accordance with commands from the system controller 72 so as to supply the generated print data to the head driver 84. Prescribed signal processing is carried out in the print controller 80, and the ejection amount and the ejection timing of the droplets of the ink and treatment liquid from the heads 50 are controlled through the head driver 84.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84 generates drive signals on the basis of print data supplied by the print controller 80, and drives the piezoelectric elements of the heads 12S, 12BK, 12M, 12C and 12Y by the drive signals. A feedback control system for maintaining constant drive conditions in the head may be included in the head driver 84.

The UV light source control unit 85 controls the on/off timing of the UV light source 26 (the UV light irradiation starting timing), the UV light irradiation duration, the UV light intensity, and the like, on the basis of a command signal supplied by the system controller 72. It is possible to provide all or a portion of the UV light source control unit 85 in the inkjet recording apparatus 10, or alternatively, it may be provided in the UV light source device including the UV light source 26 described above.

The liquid removal control unit 87 controls a liquid removal unit 97 including the porous roller 28 shown in FIG. 1. To give a specific embodiment, the liquid removal unit 97 comprises a movement mechanism (not shown) which moves the porous roller 28 in a direction including a component in a substantially perpendicular direction with respect to the print surface of the recording paper 16, and by operating this movement mechanism, the distance (clearance) between the porous roller 28 and the print surface of the recording paper 16 can be altered. In other words, a composition is adopted in which the porous roller 28 can be moved by the movement mechanism, in such a manner that, when performing liquid removal, the porous roller 28 is placed in contact with the print surface of the recording paper 16, and when not performing liquid removal, the porous roller 28 is not placed in contact with the recording paper 16.

In a mode where a suction pump is provided in the liquid removal unit 97, the liquid removal control unit 87 may control and alter the suction force of the suction pump, thereby controlling the liquid removal capability of the liquid removal unit 97. In a mode where the liquid is removed by means of the suction force of a suction pump of this kind, it is also possible to use a metal roller or a resin roller having a plurality of small holes in the surface thereof, instead of a porous roller 28 as shown in FIG. 1. More specifically, a composition is possible in which the liquid removal member of the liquid removal unit 97 shown in FIG. 6 employs a metal roller (or resin roller) having a hollow structure and having a plurality of small holes of diameter of approximately several tens micrometers (μm ) to 100 μm in the surface thereof, in such a manner that the liquid on the recording paper 16 can be removed through the holes by means of the force generated by the suction pump connected to the hollow section.

The image data to be printed is inputted from an external device (host computer 86, for example) through the communication interface 70, and is stored in the memory 74. In this stage, the RGB image data is stored in the memory 74.

The image data stored in the memory 74 is sent to the print controller 80 through the system controller 72, and is converted to the dot data for each ink color in the print controller 80. In other words, the print controller 80 performs processing for converting the inputted RGB image data into dot data for four colors, BK (K), C, M and Y. The dot data generated by the print controller 80 is stored in the image buffer memory 82.

In the present embodiment, the memory 74 is shown as a storage unit attached to the system controller 72, but the memory 74 may also be constituted by a plurality of memories (storage media). Furthermore, it is also possible to incorporate the memory into the system controller 72. The information stored in the memory 74 may include, in addition to the RGB image data described above, various setting information, system parameters, a threshold value table used to judge conditions, various types of data tables, corrective coefficients used for various corrections, and the like.

Various control programs are stored in the program storage unit 90, and a control program is read out and executed in accordance with commands from the system controller 72. The program storage unit 90 may use a semiconductor memory, such as a ROM, EEPROM, or a magnetic disk, or the like. An external interface may be provided, and a memory card or PC card may also be used. Naturally, a plurality of these storage media may also be provided.

The program storage unit 90 may also be combined with a storage device (memory) (not shown) for storing operational parameters (system parameters), and the like.

The inkjet recording apparatus 10 comprises a temperature measurement unit 92 and a humidity measurement unit 94, which measure the ambient temperature and the ambient humidity of the head 50 and the recording paper 16 in the print region. A temperature signal indicating the temperature (temperature information) measured by the temperature measurement unit 92, and a humidity signal indicating the humidity (humidity information) measured by the humidity measurement unit 94 are sent to the system controller 72. The system controller 72 controls a temperature change device, such as a heater (heating medium) which is represented with the heater 89, a cooling fan (cooling medium) (not shown), or the like, in such a manner that a prescribed (settled) temperature and humidity are maintained on the basis of the temperature signal and the humidity signal.

The inkjet recording apparatus 10 also has a recording medium determination unit 96, which determines the type of the medium used, and performs various types of control in accordance with the type of the recording medium determined by the recording medium determination unit 96. In other words, a composition is adopted wherein, when the recording medium type information determined by the recording medium determination unit 96 is sent to the system controller 72, the system controller 72 performs various controls on the basis of this recording medium type information.

The mode of determining the type of the recording medium by means of the recording medium determination unit 96 may involve an operator inputting the prescribed recording medium type through a user interface (man-machine interface), such as a keyboard, touch panel, or the like, or the type of paper used may be determined automatically by reading in information from an information recording body, such as a barcode or wireless tag, in which paper type information is recorded, this information recording body being attached to the magazine or tray of the recording paper 16. Furthermore, it is also possible to provide a sensor for sensing the recording paper 16, in such a manner that the type of recording paper 16 is determined from the sensing results of the sensor. In a mode using a sensor which determines the recording paper 16 and the image formed on the print surface of the recording paper 16, the image printed on the recording paper 16 is read in through the sensor, the ejection state (presence or absence of ejection, variation in ejected droplets, and the like) is determined by carrying out prescribed signal processing, or the like, and the determination result is supplied to the print controller 80, which is then able to perform various corrections with respect to the heads 50, on the basis of the information obtained through the sensor, as and when necessary. A line sensor or area sensor is suitable for use in a sensor of this kind.

Description of Treatment Liquid and Ink

Next, the ink used in the inkjet recording apparatus 10 is described. The inkjet recording apparatus 10 uses the water-based emulsion-type UV ink containing a pigment-based ink coloring material and a UV monomer (or a UV oligomer, or a mixture of a UV oligomer and a UV monomer), and the constituent materials are dispersed in an ink solvent having water as a principal component. In one embodiment, the composition of a water-based emulsion-type UV ink includes water, a UV monomer (or UV oligomer), a pigment (ink coloring material), a surfactant, a wetting agent, and the like.

In the treatment liquid that reacts with the water-based emulsion-type UV ink, for the material breaking down the dispersed state of the constituent materials such as the UV monomer dispersed in the ink solvent, it is possible to use a pH adjuster (an inorganic acid, such as hydrochloric acid, sulfuric acid and phosphoric acid, or an organic acid, such as carboxylic acid, sulfonic acid, acetic acid and methane sulfonic acid), a multivalent metallic salt (including multivalent metallic ions of various types, such as aluminum, calcium, magnesium, iron, zinc, or tin), or the like. Desirably, the organic acid described above is an acid that contains carboxylic acid, sulfonic acid, or the like. To give one embodiment, the composition of a treatment liquid of this kind includes: water, an aggregating agent (acid and multivalent metallic ions), a reaction initiator, a surfactant, and a wetting agent.

When the ink and the treatment liquid having the compositions described above react with each other on the recording paper 16, the materials emulsified in the ink solvent, namely, the pigment-based ink coloring material and the UV monomer (or UV oligomer, or mixture of UV monomer and UV oligomer), aggregate and settle, thus separating the ink solvent and the aggregated materials into separate phases: an upper phase and a lower phase.

Description of Image Formation Control

Figure 7:
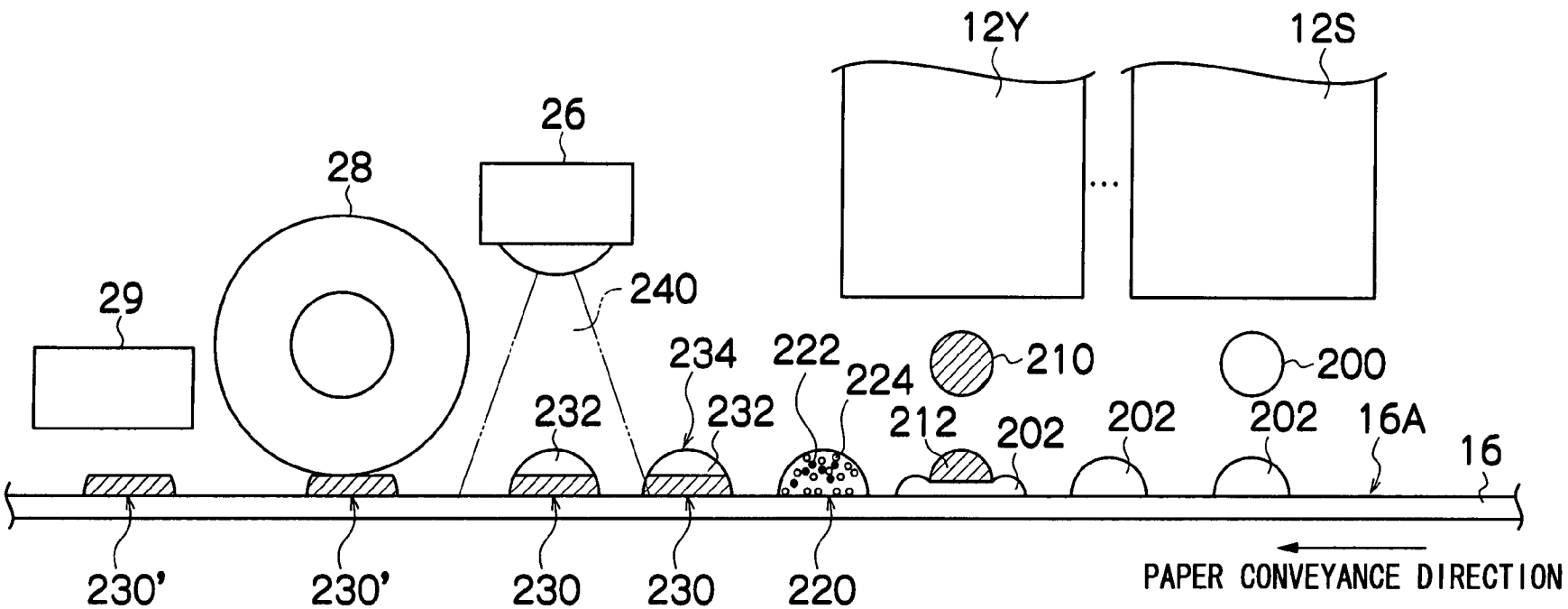
FIG. 7 is a conceptual diagram showing an image forming method according to the present invention.

Next, the image forming method (image formation control) according to an embodiment of the present invention is described with reference to FIG. 7. FIG. 7 is a conceptual diagram for describing the respective steps of the present image forming method.

As shown in FIG. 7, treatment liquid 200 is ejected from the treatment liquid ejection head 12S, and the treatment liquid is deposited on the print surface 16A of the recording paper 16 (treatment liquid deposition step). Reference numerals 202 denote treatment liquid droplets that have been deposited on the print surface 16A of the recording paper 16.

The treatment liquid deposited on the print surface 16A of the recording paper 16 needs to remain on the print surface 16A until the time at which the Y ink ejected from the yellow ink head 12Y, which is at the furthest downstream position in the paper feed direction from the treatment liquid ejection head 12S, lands on the print surface 16A. Furthermore, the treatment liquid must be of an amount corresponding to the total amounts of the inks of colors deposited by the four ink heads 12BK, 12M, 12C and 12Y shown in FIG. 1 (namely, an amount sufficient to allow all of the color inks to react with the treatment liquid). Therefore, the amount of the treatment liquid deposited on the recording paper 16 is specified by taking account of conditions, such as the ink deposition amounts, the permeation time (the permeation characteristics) of the treatment liquid into the recording paper 16, and the conveyance speed of the recording paper 16, and the like.

When a prescribed amount of treatment liquid has been deposited on the print surface 16A of the recording paper 16 by the treatment liquid deposition step, ink 210 is then deposited by the ink heads 12BK, 12M, 12C and 12Y, onto the region where the treatment liquid has been deposited (ink ejection step). FIG. 7 shows only the ink head 12Y of the ink heads 12BK, 12M, 12C and 12Y. Reference numeral 212 shown in FIG. 7 denotes a Y ink droplet that has landed on the treatment liquid droplet 202 having been deposited on the print surface 16A of the recording paper 16.

When the ink (Y ink 212) has landed on the treatment liquid 202 deposited on the print surface 16A of the recording paper 16, in the ink ejection step, the treatment liquid and the ink react with each other and the dispersed state of the ink is broken down. The ink droplet denoted with reference numeral 220 in FIG. 7 shows a droplet in which the dispersed state has been broken down, and this droplet 220 contains an ink coloring material 222 and a constituent material 224, such as a UV monomer.

In the droplet 220 whose dispersed state has broken down as shown in FIG. 7, an aggregate 230 of the ink coloring material and the constituent material, such as the UV monomer, is generated, and the ink solvent 232 and the aggregate 230 separate into different phases: an upper phase and a lower phase.

When the droplet on the recording paper 16 has assumed a state of separate phases, in which the aggregate 230 and the ink solvent 232 have become separated, as denoted with reference numeral 234 in FIG. 7, then UV light 240 is irradiated from the UV light source 26 onto at least the settled aggregate 230, thereby curing the aggregate 230 (curing step).

The curing step of the aggregate 230 of the ink coloring material, and the like, by irradiating UV light 240, includes a mode in which the aggregate 230 is completely cured, and also a mode in which the aggregate 230 is semi-cured, to a level which prevents it from moving from its prescribed position on the recording paper 16, and which prevents the ink coloring material from adhering to the surface of the porous roller 28 when it comes into contact with the porous roller 28.

When the aggregate 230 has been cured in the curing step, the porous roller 28 is placed in contact with the print surface 16A of the recording paper 16, and the liquid on the recording paper 16, including the ink solvent 232, the unreacted treatment liquid (not shown), and the like, is removed (liquid removal step). FIG. 7 shows a case where the porous roller 28 makes contact with a cured aggregate 230', but in actual practice, the porous roller 28 is moved in the thickness direction of the recording paper 16 (namely, the pressure applied to the recording paper 16 by the porous roller 28 is altered), in such a manner that the porous roller 28 makes contact with the print surface 16A of the recording paper 16. In this way, by curing the aggregate (ink coloring material), it is possible to prevent the ink coloring material from adhering to the porous roller 28, as well as being able to form desirable image that is free of image distortion, on the recording paper 16.

Moreover, if the aggregate (ink coloring material) 230' is leveled by varying the pressure with which the porous roller 28 makes contact with the recording paper 16 (namely, if the pile height (ink thickness) is reduced by applying pressure to the aggregate 230'), then it is possible to suppress relief effects occurring in the image formed on the recording paper 16.

When the liquid removal step has been carried out by means of the liquid removal unit 97 (shown in FIG. 6) comprising the porous roller 28, then the recording paper 16 is dried by means of the drying unit 29 (drying step). In the drying process performed by the drying unit 29, it is preferable that the amount of heat applied to the recording paper 16 is controlled in accordance with the type of recording paper 16, as determined by the recording medium determination unit 96 shown in FIG. 6, and the amount of liquid remaining on the recording paper 16.

In the inkjet recording apparatus 10 having the composition described above, the water-based emulsion-type UV ink is used, and the treatment liquid is made to react with the ink to create an aggregate of the ink coloring material and the UV monomer or other constituent material, thereby separating the ink into an ink solvent and an aggregate, whereupon the aggregate of the ink coloring material, and the like, is cured by irradiation of UV light, and after this curing of the aggregate, the liquid including the ink solvent and the unreacted treatment liquid is removed. Therefore, it is possible to promote the fixing of the ink coloring material onto the recording paper 16 by means of irradiation of UV light, as well as accelerating the liquid removal (drying speed) compared to heat-based drying, and furthermore, it is also possible to reduce the energy required to remove the liquid, compared to heat-based drying. Moreover, since the aggregate, such as the ink coloring material, is cured (or semi-cured) at the time that liquid removal is carried out, then there is no adherence of the ink coloring material, or the like, to the porous roller 28 during liquid removal, and there is no disturbance of the image formed on the recording paper 16.

Furthermore, since high-speed printing is carried out using the water-based emulsion-type UV ink, it is possible to reduce the pile height of the ink, without detracting from the advantages relating to printing speed (ink fixing speed), in comparison with a 100% curable UV ink, and therefore, a desirable image that is free of relief effects is formed on the recording paper 16.

By using water as the principal component of the ink solvent, the odors generated by inks containing monomers or oligomers are reduced, and furthermore, the volatility of the ink is reduced and evaporation of undesirable substances is suppressed.

FURTHER EMBODIMENTS

In the embodiments described above, one treatment liquid ejection head 12S is disposed at the furthest upstream position of the print unit 12 (see FIG. 1), but in implementing the present invention, the arrangement of the treatment liquid ejection head is not limited to these embodiments, and it is also possible to adopt a composition in which a treatment liquid ejection head is appended at at least one position between the color heads in the print unit 12. The treatment liquid ejection head 12S and the print heads 12BK, 12M, 12C and 12Y may be constituted as an integrated body, and the treatment liquid head may be provided as a portion of each of the heads 12BK, 12M, 12C and 12Y (in other words, a portion of the nozzles of each of the print heads 12BK, 12M, 12C and 12Y may be used as treatment liquid ejection nozzles).

Furthermore, in the embodiments described above, an ejection head based on an inkjet method is used as the device for depositing the treatment liquid, but instead of or in combination with this, it is also possible to use a device which applies the treatment liquid to the recording paper 16 by using a contacting member, such as a roller, brush, blade, or the like.

In the foregoing embodiments, an inkjet recording apparatus using the page-wide full line type heads having nozzle rows of a length corresponding to the entire width of the recording paper 16 is described, but the scope of application of the present invention is not limited to this, and the present invention may also be applied to an inkjet recording apparatus using a shuttle head which performs image recording while moving a recording head of short dimensions back and forth.

The foregoing embodiments concern an inkjet recording apparatus for forming images on a recording paper 16 by ejecting ink from nozzles provided in the print heads, but the scope of application of the present invention is not limited to this, and it may also be applied broadly to image forming apparatuses which form images (three-dimensional shapes) by means of a liquid other than ink, such as resist, or to liquid ejection apparatuses, such as dispensers, which eject liquid chemicals, water, or the like, from nozzles (ejection holes).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming method, comprising:

a treatment liquid deposition step of depositing, on a recording medium, a treatment liquid which reacts with a water-based emulsion-type ink comprising a water-based ink solvent, a pigment-based coloring material and at least one constituent material of a radiation-curable monomer, a radiation-curable oligomer, and a mixture material of the radiation-curable monomer and the radiation-curable oligomer;

an ink ejection step of ejecting the water-based emulsion-type ink by means of an inkjet head toward the recording medium on which the treatment liquid has been deposited in the treatment liquid deposition step;

a radiation irradiation step, in a state where the water-based emulsion-type ink has reacted with the treatment liquid on the recording medium after the ink ejection step and an aggregate of the pigment-based coloring material and the at least one constituent material is separated in phase from a liquid component including the water-based ink solvent, of irradiating radiation onto at least the aggregate on the recording medium, to cure the aggregate; and a liquid removal step of removing at least a portion of the liquid component from the recording medium, after the radiation irradiation step.

2. The image forming method as defined in claim 1, further comprising a drying step of drying the recording medium from which the at least the portion of the liquid component has been removed in the liquid removal step.

3. An inkjet recording apparatus, comprising:

a treatment liquid deposition device which deposits, on a recording medium, a treatment liquid which reacts with a water-based emulsion-type ink comprising a water-based ink solvent, a pigment-based coloring material and at least one constituent material of a radiation-curable monomer, a radiation-curable oligomer, and a mixture material of the radiation-curable monomer and the radiation-curable oligomer;

an inkjet head which ejects the water-based emulsion-type ink toward the recording medium on which the treatment liquid has been deposited by the treatment liquid deposition device;

a radiation irradiation device which irradiates radiation, in a state where the water-based emulsion-type ink ejected by the inkjet head has reacted with the treatment liquid deposited by the treatment liquid deposition device on the recording medium and an aggregate of the pigment-based coloring material and the at least one constituent material is separated in phase from a liquid component including the water-based ink solvent, onto at least the aggregate on the recording medium, thereby curing the aggregate; and a liquid removal device which removes at least a portion of the liquid component from the recording medium in a state where the aggregate is separated from the liquid component.

4. The inkjet recording apparatus as defined in claim 3, further comprising a drying device which dries the recording medium from which the at least the portion of the liquid component has been removed by the liquid removal device.

5. The inkjet recording apparatus as defined in claim 3, wherein the liquid removal device has an absorbing body which makes contact with the liquid component on the recording medium, thereby absorbing and removing the at least the portion of the liquid component from the recording medium.

6. The inkjet recording apparatus as defined in claim 3, wherein the treatment liquid deposition device includes a treatment liquid ejection head which ejects the treatment liquid toward the recording medium.

* * * * *